US005915847A

United States Patent [19]

Spears

[11] Patent Number: 5,915,847

[45] Date of Patent: Jun. 29, 1999

[54] DRAIN STOPPER WITH LIFT MECHANISM

[76] Inventor: Cecil J. Spears, 231 Hunting Ridge Rd., Roanoke Rapids, N.C. 27870

[21] Appl. No.: 09/030,087

[22] Filed: Feb. 25, 1998

[51] Int. Cl.[6] ..... E03C 1/26

[52] U.S. Cl. ..... 4/287; 4/293; 4/295

[58] Field of Search ..... 4/286, 287, 292, 4/295, 288, 293

[56] References Cited

U.S. PATENT DOCUMENTS

| | | | |
|---|---|---|---|
| Re. 14,630 | 4/1919 | Abbott . | |
| 238,726 | 3/1881 | Sponsler . | |
| 246,567 | 8/1881 | Sneider . | |
| 327,573 | 10/1885 | McArthur . | |
| 487,327 | 12/1892 | Hopkins . | |
| 624,384 | 5/1899 | Schroeder . | |
| 673,762 | 5/1901 | Crabb . | |
| 756,663 | 4/1904 | Lewis . | |
| 983,797 | 2/1911 | Andrews . | |
| 984,259 | 2/1911 | Beck | 4/288 |
| 1,081,434 | 12/1913 | Cote . | |
| 1,141,378 | 6/1915 | Carney . | |
| 1,203,530 | 10/1916 | Gessler . | |
| 1,596,894 | 8/1926 | Schifter | 4/287 |
| 1,645,986 | 10/1927 | Crocker . | |
| 1,925,008 | 2/1933 | Schacht . | |
| 1,939,569 | 12/1933 | Pfister . | |
| 2,199,964 | 5/1940 | Rook | 4/295 |
| 2,321,515 | 6/1943 | Rice . | |
| 2,329,242 | 9/1943 | Best . | |
| 2,348,093 | 5/1944 | Pasman | 4/287 |
| 3,380,081 | 4/1968 | Eilertson et al. . | |
| 3,665,526 | 5/1972 | Hoffman . | |
| 4,932,082 | 6/1990 | Ridgeway . | |
| 5,636,757 | 6/1997 | Porvaznik . | |

FOREIGN PATENT DOCUMENTS

| | | |
|---|---|---|
| 468618 | 11/1928 | Germany . |
| 713668 | 8/1954 | United Kingdom . |

*Primary Examiner*—Charles R. Eloshway

*Attorney, Agent, or Firm*—Kerkam, Stowell, Kondracki & Clarke, P.C.; Edward J. Kondracki; John C. Kerins

[57] ABSTRACT

A drain stopper having a lift mechanism or assembly and, optionally, a strainer assembly, is provided wherein a sealing member which may be a stopper plug or a flat disc is coupled to an elongate rod having a pair of legs extending in one direction and a handle extending in an opposite direction. The rod extends transversely across a top of the sealing member, and is coupled to the sealing member in a manner so as to permit rotation thereof. When the rod is rotated to urge the legs downwardly along the sides of the sealing member, the legs will engage the drain and, through lever or camming action, lift the sealing member upwardly from the drain. A strainer assembly includes a member extending downwardly from the underside of the sealing member which holds a screen at a lower extent of the extension member.

14 Claims, 5 Drawing Sheets

DRAIN STOPPER WITH LIFT MECHANISM

BACKGROUND OF THE INVENTION

1. Field of the Invention

The present invention is directed to a drain stopper having a lift mechanism thereon.

2. Description of Related Art

Various drain stopper designs have been developed with the goal of making the stopper more effective or more convenient to use in the household. The following patents are representative of designs of drain stoppers or lift mechanisms for stoppers.

| U.S. Pat. No. | Inventor |
|---|---|
| 14,630 | Abbott |
| 238,726 | Sponsler |
| 246,567 | Sneider |
| 756,663 | Lewis |
| 1,141,378 | Carney |
| 1,203,530 | Gessler |
| 1,939,569 | Pfister |
| 2,321,515 | Rice |
| 3,380,081 | Eilertson et al. |
| 3,665,526 | Hoffman |
| 4,932,082 | Ridgeway |

In addition to the above U.S. patents, German patent DE 468118 and British patent UK 713,668 appear to be directed to plugs or stoppers for a drain. None of the foregoing patents, however, is directed to a drain stopper which can easily be lowered to a closed position, and raised and held in an open position, and for, optionally, complete removal, and wherein the drain stopper is of extremely simple design.

It is therefore a principal object of the present invention to provide a drain stopper having a simple lever or camming mechanism to control the raising and lowering of the stopper in the drain, and to position the stopper in the drain.

It is further principal object of the present invention to provide a drain stopper having a simple lift mechanism and having a strainer assembly attached thereto.

SUMMARY OF THE INVENTION

The above and other objects of the present invention are provided by a drain stopper having a sealing member which generally may be a traditional tapered, frustoconical resilient plug, with a projection extending upwardly from a top surface thereof, and with the projection having a transverse bore therethrough. The sealing member may alternatively be a flat disc of metal or of a flexible material.

The lift assembly is made up of a cylindrical rod extending through the opening in the plug projection and the rod is of a length sufficient to extend past the periphery of the plug. The ends of the cylindrical rod are provided with legs extending substantially perpendicularly to the rod, and are spaced apart at a distance so as to be capable of straddling the plug and to be capable of contacting a top flange of a drain installed in, for example, a sink. Disposed in substantially the same plane as the legs is a diametrically opposed handle which is attached to the cylindrical rod in a manner so as to straddle the projection on top of the plug. The rod is pivotable within the opening in the projection, and thus moving the handle will rotate the rod and rotate the legs depending therefrom, with the handle and legs moving in opposite directions.

The drain stopper also has a strainer assembly extending downwardly underneath the plug. The strainer assembly has a screen held in position parallel to the plug, and is of a size to fit within the drain at a closely spaced distance from the cylindrical wall of the drain. The screen is held in position by either a pair of arms extending downwardly from the plug, or by a perforated cylindrical member. The strainer assembly thus serves to trap most solid particles before they enter the plumbing, but will not itself get stuck or be difficult to remove from the drain.

The plug is positioned in its closed position, blocking flow through the drain, by positioning the legs and handle of the lift mechanism substantially parallel to the upper surface of the plug. To move or position the plug in an open, unseated position, the handle is raised, thereby rotating the legs downwardly, with the legs pushing against the drain to lift the plug out of its seated position. The plug may be retained at an open position by rotating the legs into a substantially vertical orientation, where upon the legs will hold the plug at a spaced apart distance from the drain opening.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments taken in conjunction with the accompanying drawings wherein like reference characters represent like parts throughout the several views.

DETAILED DESCRIPTION OF THE PREFERRED EMBODIMENTS

Figure 1:
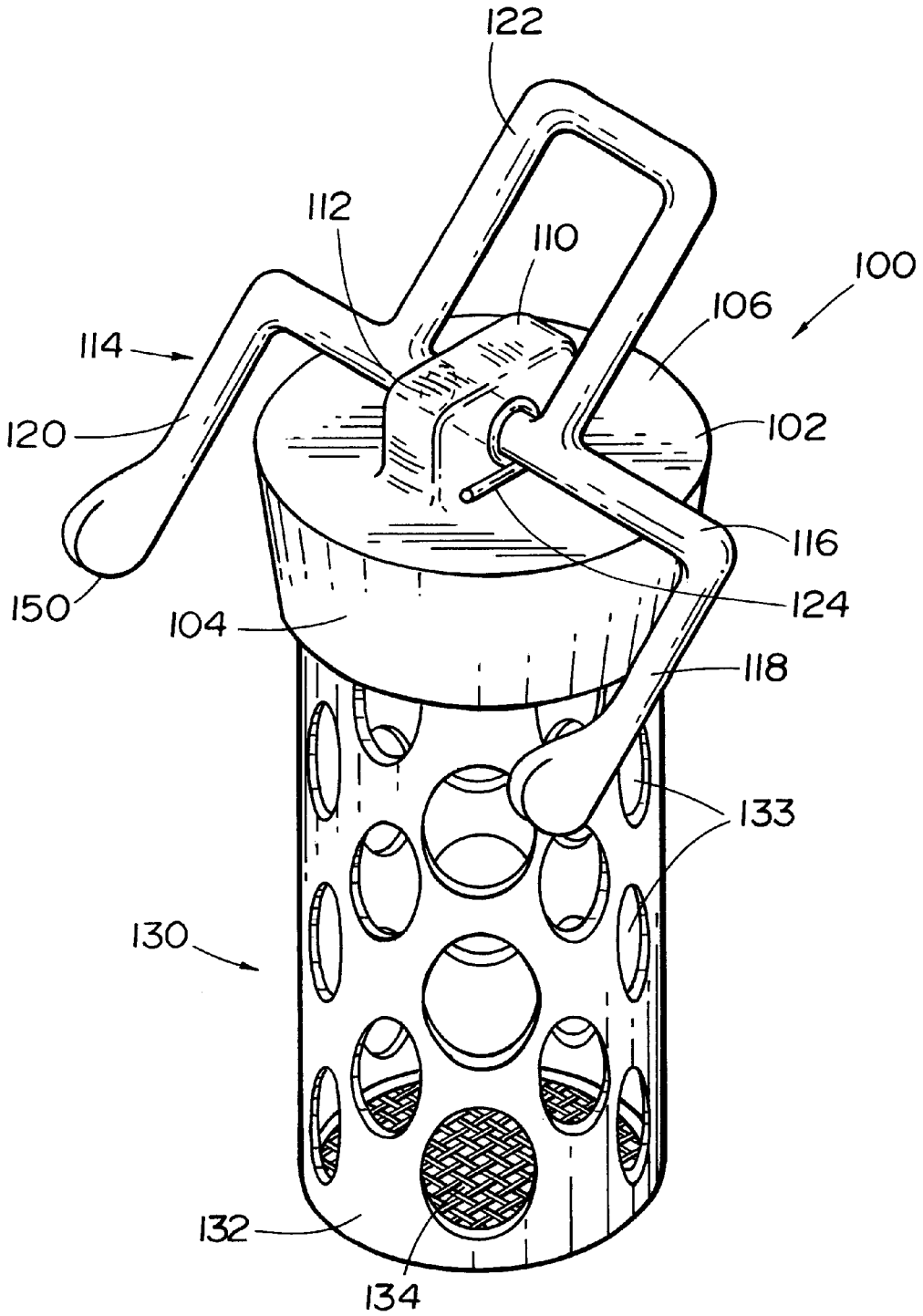
FIG. 1 is a perspective view of a first preferred embodiment of the drain stopper of the present invention.
Figure 3:
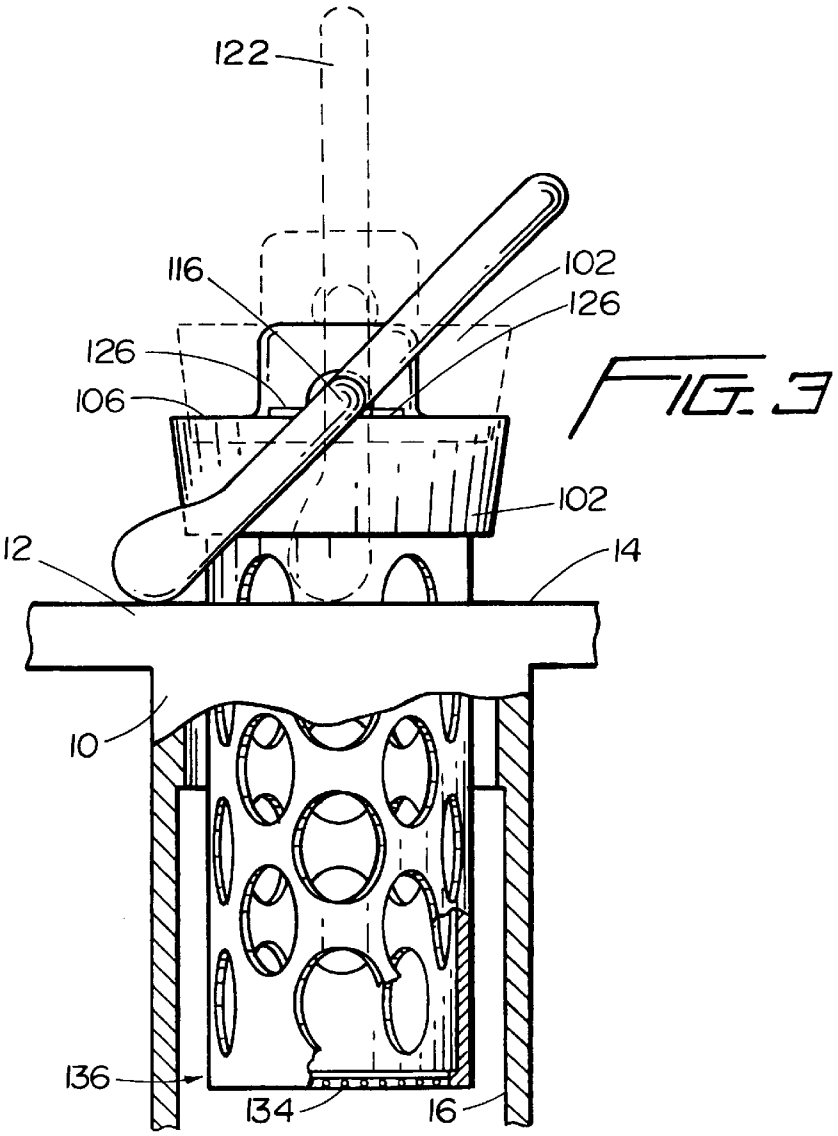
FIG. 3 is a side, partial cutaway view of the drain stopper in FIG. 1, as positioned in a partially open position in an existing drain.
Figure 2:
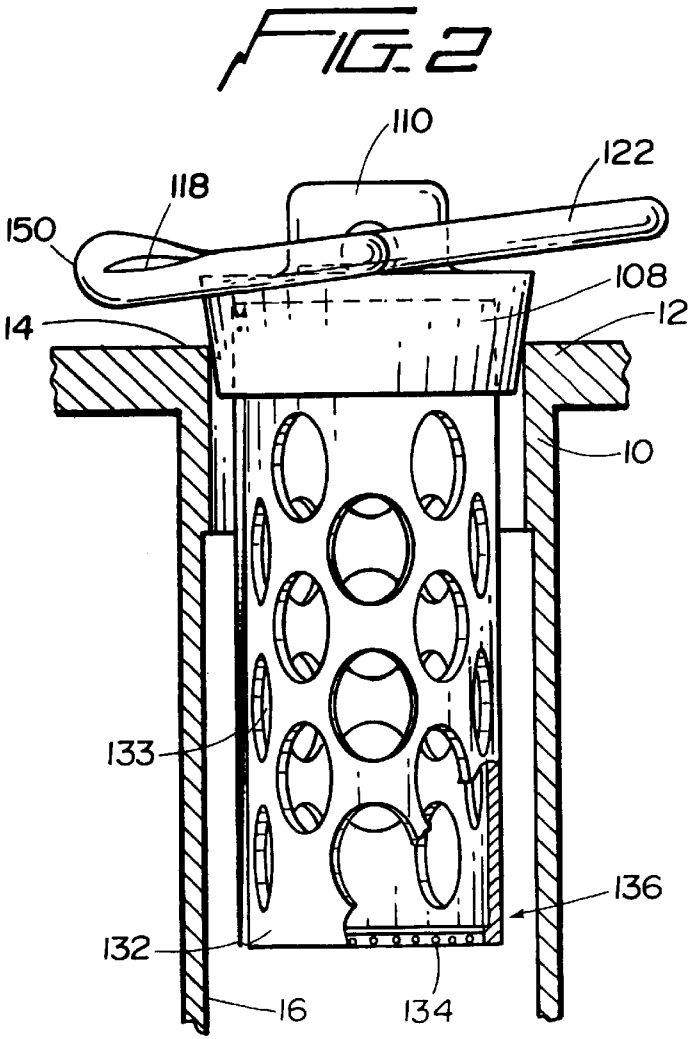
FIG. 2 is a side, partial cutaway view of the drain stopper in FIG. 1, as positioned in a closed position in an existing drain.

Referring initially to FIGS. 1–3, a first preferred embodiment of the drain stopper 100 of the present invention is illustrated. The drain stopper 100 has a resilient plug 102 that is sized and shaped to provide a seal against an upper portion of an existing drain 10 (FIGS. 2 and 3).

The plug 102 will generally be of the same type as is in common use today, wherein the sealing surface 104 is substantially frustoconical in shape, and wherein a top surface 106 is substantially planar or is slightly convex. The underside of the plug may preferably define a recess 108 (see broken lines, FIG. 2). Plug 102 has a projection 110 extending upwardly from upper surface 106, and the projection 110 has a bore 112 extending transversely therethrough.

Attached to plug 102 is a stopper lift assembly or mechanism 114. The lifting assembly 114 includes an elongate cylindrical rod 116 that extends through bore 112, with rod 116 and bore 112 being sized to provide a snug fit, but with rod 116 being rotatable within the bore. The axis of rotation of rod 116 is substantially parallel to the upper surface 106 of the plug.

Rod 116 extends laterally past the peripheral edges of plug 102, and has a first leg 118 and a second leg 120 extending substantially perpendicularly to the longitudinal axis of rod 116. The length of rod 116 and the position of legs 118, 120, is such that, when the legs are positioned to extend downwardly (FIGS. 1 and 3), the legs 118, 120, straddle the plug 102. The legs are further spaced apart from one another at a distance such that, when extending downwardly, the legs will contact and engage opposing sides of an upper flange 12 (FIG. 3) of drain 10.

A handle 122 is attached to rod 116, preferably to lie in substantially the same plane as legs 118, 120 (FIGS. 2 and 3), and to extend in a direction diametrically opposite the direction in which the legs extend. The handle 122, as illustrated, is a squared-off U-shaped member whose two ends are affixed to cylindrical rod 116 at opposite sides of projection 110.

Because the projection 110 is preferably formed of the same resilient material making up the remainder of plug 102, the plug 102 is further preferably provided with two lifting assembly stabilizers 124 (one shown), which preferably consist of metal wire formed into a loop and two legs 126 extending therefrom and forming a straight line, such that the stabilizer legs 126 can be secured to the upper surface 106 of the plug, for example, with epoxy, at opposite sides of projection 110. The loop portion of the stabilizers is of a size that will closely surround rod 116, permitting rod 116 to rotate within the loop, but will engage and resist movement of the rod when, for example, the rod is forced upwardly in moving the drain stopper 100 to an open position, or when the stopper is being lifted from the drain 10. The stabilizers 124 further substantially prevent the rod 116 from being moved in a twisting motion.

Extending downwardly from plug 102 is a strainer assembly 130. In this preferred embodiment, the strainer assembly 130 is made up of a hollow cylindrical section 132 of plastic tubing or pipe, such as PVC pipe. The cylindrical section has a considerable number of holes 133 created through the wall of the section. A screen 134 is secured to the cylindrical section, preferably at or near the lower end 136 of the section, and the screen preferably spans the entire cross-section of the cylindrical section.

The strainer assembly is preferably sized such that an outer diameter of cylindrical section 132 fits inside recess 108 in plug 102. The strainer assembly can thus be mounted to the plug 102 by adhesive, such as an epoxy. Screen 134 may also be secured to the cylindrical section by use of an adhesive such as an epoxy.

As can be seen in looking at FIGS. 2 and 3, the operation of the drain stopper and the strainer assembly is illustrated. The drain stopper 100 is in its closed position in FIG. 2, with the handle 122 and legs 118, 120, positioned in approximately a horizontal plane. At a minimum, the legs 118 and 120 should be positioned such that they are not exerting sufficient upward force on plug 102 to lift it from seating against the upper flange 12 of drain 10. When it is desired to unseat plug 102 to open drain 10, the handle 122 is rotated upwardly, which, in turn, rotates legs 118, 120 downwardly to bear against an upper surface 14 of drain flange 12.

The handle 122 is pulled until sufficient force is exerted by legs 118, 120 against drain flange 12 to lift, by lever action, plug 102 from its seated position (solid lines in FIG. 3). If it is desired to completely remove the drain stopper from the sink, continued lifting on handle 122 will raise the entire assembly from the sink. Alternatively, if it is desired to open the drain, but to leave the drain stopper positioned in the drain, the user can continue to rotate handle 122 and legs 118, 120 into a substantially vertical orientation (broken lines in FIG. 3). In that position, legs 118, 120 will stably hold the plug 102 at a position over the drain 10, allowing water or other fluid to flow into the drain, and allowing the stopper to be readily repositioned to close the drain by reversing the rotation of the handle and legs to the position illustrated in FIG. 2.

The strainer assembly performs at least two beneficial functions for the drain stopper assembly 100. As can best be seen in FIGS. 2 and 3, the strainer assembly 130 extends downwardly from the plug 102 into the drain, when the drain stopper is in place in the drain. Upon the unseating of the stopper from the drain (FIG. 3), the water or fluid held in the sink will begin to flow through the drain 10. Any solids suspended in the water will be carried down the drain as well. With the strainer assembly 130 being closely spaced to the inner drain wall 16 (the spacing in FIGS. 2 and 3 is somewhat exaggerated), the majority of the water emptying from the sink or other receptacle above the drain, will flow into the holes or openings 133 in the cylindrical member 132, and the screen 134 at the bottom of the cylindrical section will thus trap any solids larger than the screen opening size. This will prevent large pieces of solids from traveling through the drain which might clog the drain or otherwise affect the operation of the drain.

A second beneficial function of the strainer assembly is that it provides stability to the drain stopper 100 when in the fully open position shown in broken lines in FIG. 3. If the plug 102 or handle 122 is jostled around, either by the user of the sink, or by pots, pans, utensils, or other like items placed in the sink, the cylindrical section 132 will bear against the inner drain wall 16 to prevent dislodgement of the drain stopper 100 from its desired position.

Figure 4:
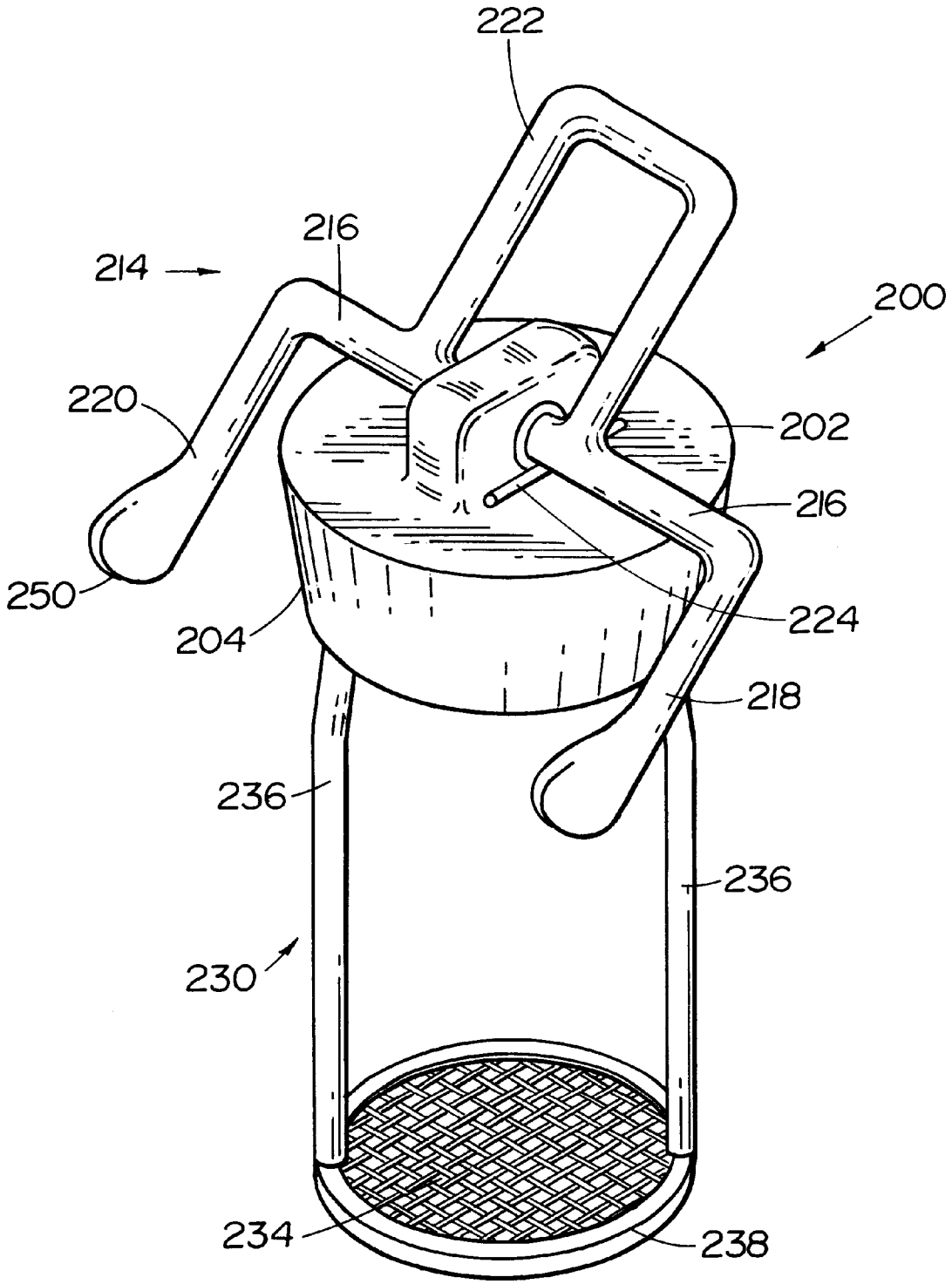
FIG. 4 is a perspective view of a second preferred embodiment of the drain stopper of the present invention.
Figure 6:
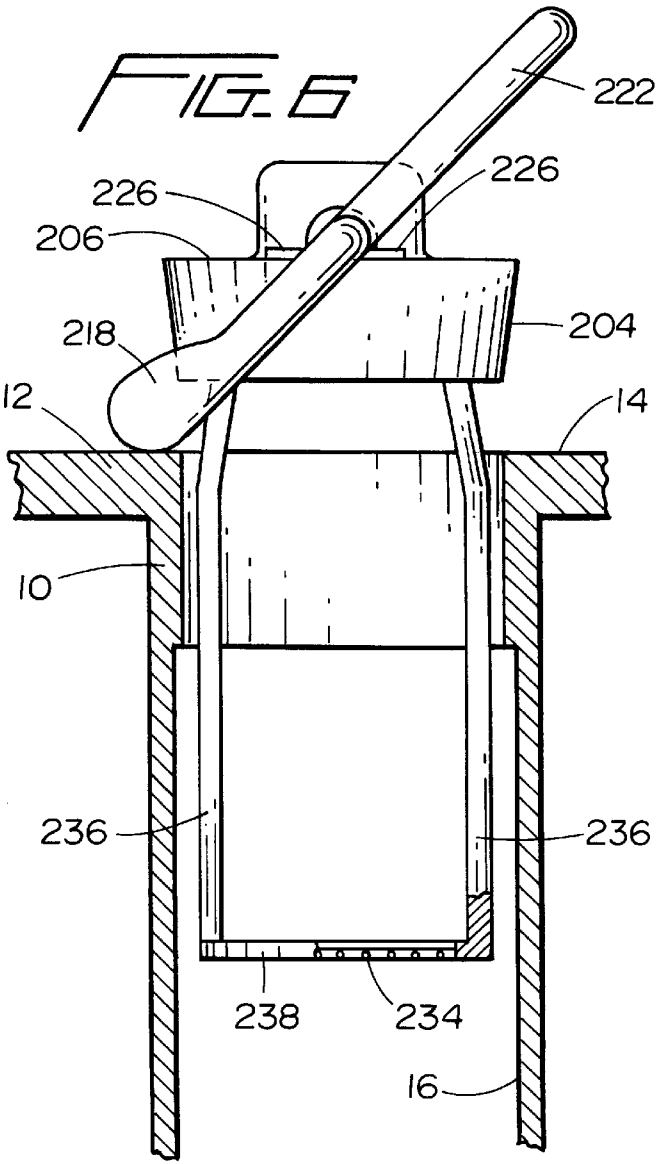
FIG. 6 is a side, partial cutaway view of the drain stopper in FIG. 4, as positioned in a partially open position in an existing drain.
Figure 5:
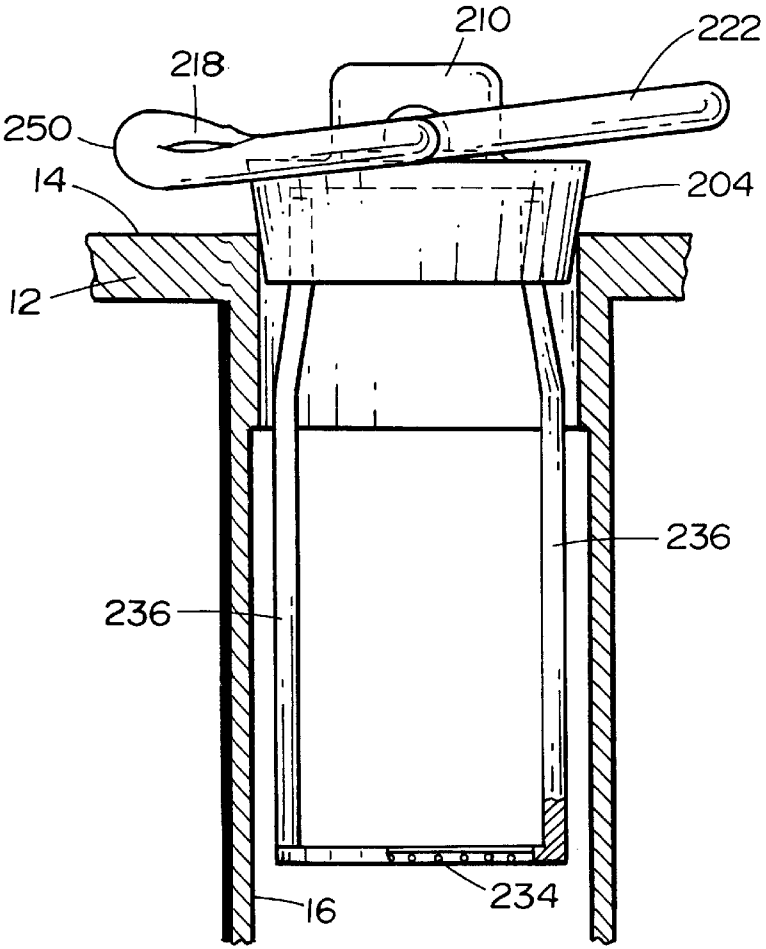
FIG. 5 is a side, partial cutaway view of the drain stopper in FIG. 4, as positioned in a closed position in an existing drain.

The second preferred embodiment of the instant invention is illustrated in FIG. 4–6. In these figures, many of the components are identical to those shown in FIGS. 1–3. The principal difference in this second preferred embodiment is the construction of strainer assembly 230. Briefly, the drain stopper 200 of this preferred embodiment includes a plug 202 having a seating surface 204 and an upper surface 206. The plug 202 has a projection 210 having a bore therethrough.

A lift assembly or mechanism 214 is made up of elongate rod 216 having legs 218, 220 extending perpendicularly thereto, and a diametrically opposed handle 222. The positioning and operation of lift assembly 214 is stabilized by stabilizers 224 whose legs 226 are secured to the upper surface 206 of plug 202.

The strainer assembly 230 in this embodiment is made up of a screen 234 held in position by a pair of arms 236 that are secured, as by epoxying, for example, in recess 208 (see FIG. 5) of plug 202. The arms 236 are attached to opposing sides of screen 234. Screen 234 may have a support ring 238 extending around the periphery thereof, or may, if of sufficient strength to be self-supporting, be attached directly to arms 236 without the use of a support ring. In that event, the arms would preferably have a small tab (not shown) extending inwardly such that the screen 234 can be secured to the top of the tabs.

The drain stopper assembly 200 operates in essentially an identical manner as that described with respect to the first preferred embodiment discussed above. The strainer assembly 230 of the drain stopper also provides the same benefits of straining large solid particles carried by the fluid being drained, and the stabilizing of the drain stopper 200 when in the fully open position, positioned in and resting above the drain.

It is to be noted that components such as plug lifting assembly 114, 214, stabilizers 124, 224, and arms 236 can preferably be made from copper rod or wire stock, of appropriate cross-sectional thicknesses to provide the necessary strength to those components. Other materials resistant to corrosion in water, such as substantially rigid plastics or thermoplastic materials, may also advantageously be used. As an illustrative example, a straight copper rod may be bent into the shape of the elongate rod 116, 216, with legs 118, 120, 218, 220 depending therefrom. In this construction, the ends of the copper rod can be bent back on themselves to form the rounded lower surface 150, 250 that will bear against drain flange 12 in operation. Handle 122, 222 may be joined to rod 116, 216 by wrapping ends of the handle around rod 116, 216, and then crimping the parts together. Alternatively, the handle and rod may be soldered together or fastened in any other conventional way.

Figure 8:
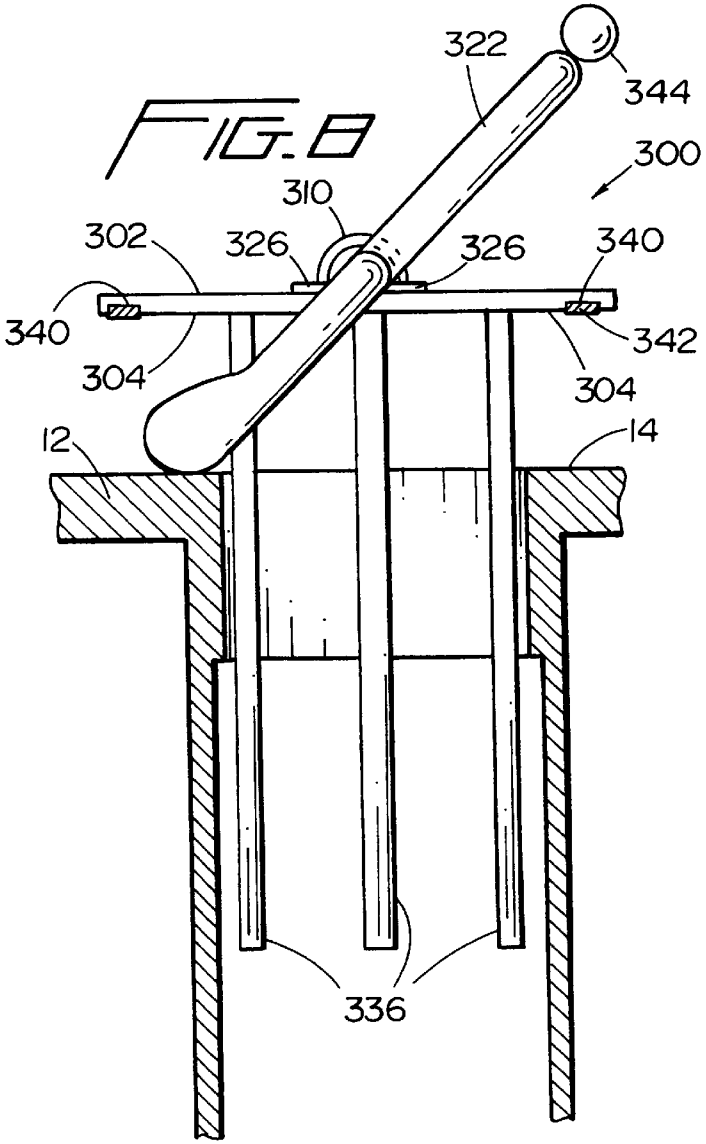
FIG. 8 is a side, partial cutaway view of the drain stopper of FIG. 7, but in an open position.
Figure 7:
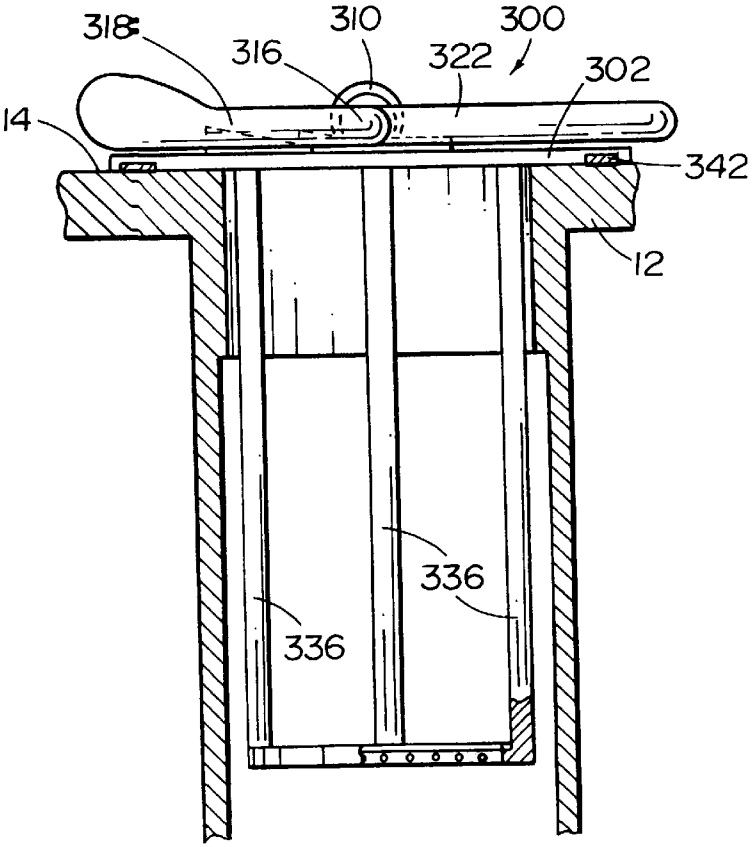
FIG. 7 is a side, partial cutaway view of a drain stopper in accordance with a third preferred embodiment of the present invention, with the sealing member in closed position.

In addition, while the two foregoing illustrated embodiments each display a plug of the type having a frustoconical tapered seating surface along a side wall, the plug can also be simply a flat sealing member, as shown in FIGS. 7 and 8. This embodiment may indeed be the most desirable embodiment from the standpoint of aesthetics and consumer appeal.

In FIGS. 7 and 8, the drain stopper 300 has a flat sealing member 302 preferably in the shape of a disc. The disc 302 can be a thin metal disc made of, for example, stainless steel. The disc 302 will preferably have a flat lower surface 304, and will preferably be of a thickness that will allow the disc to flex to closely conform to the upper surface 14 of the drain flange 12 or the bottom portion of the basin in which the drain stopper is employed. The flatness of the lower surface 304, combined with the disc having the ability to flex to a degree, will generally provide an adequate fluid seal when the disc 302 is brought into contact with drain flange 12. The weight of any water or other fluid being retained in the basin will further act to seal disc 302 against the drain flange.

In addition, the disc is provided with two or more arms 336, and preferably four arms (three shown) attached to the lower surface 304 of the disc 302, and depending downwardly therefrom. The arms 336 provide added weight to pull the disc 302 against the drain flange 12 when the stopper is lowered into its closed position. The arms also substantially prevent the inadvertent lifting of the disc at its edges, in that they provide stability by bracing against the drain when the disc attempts to lift at one side.

In the event it is desired to provide enhanced fluid sealing, the disc 302 can be provided with an annular groove 340 machined, stamped or embossed into the lower surface 304. A resilient gasket 342 made of, for example, natural or synthetic rubber, is positioned in the groove 340, and may preferably protrude slightly past the lower surface 304 of disc 302. The gasket 342 will, upon being lowered to the position illustrated in FIG. 7, engage the surface of the drain flange or basin, and its resilience will cause it to closely conform to that surface, as it is urged downwardly by the weight of the stopper 300.

It will be noted in comparing FIGS. 7 and 8 that the embodiment of FIG. 8 provides the arms 336, even though no strainer is provided. The arms 336 are still desired to provide the stability in both the open and closed positions, as discussed previously.

The projection 310 in the FIG. 7 and FIG. 8 embodiment may preferably be a small plate or other shape made of the same material or the disc. The drain stopper 300 may optionally be provided without a projection, and may rely only on stabilizers 326 to retain the rod 316 in position while permitting rotation thereof.

In the embodiment illustrated in FIGS. 7 and 8, it may be desirable to include a lifting aid on handle 322, in that, as seen in FIG. 7, the handle 322, when in a closed position, will lie extremely close to the drain flange or bottom surface of the basin. The lifting aid may preferably comprise a ball or sphere 344 (FIG. 8) that the user can either grip or can place a thumb or finger underneath in initially lifting the handle. Alternatively, the handle may be inclined upwardly out of the plane defined by rod 316 and legs 318, 320, in order to provide a larger spacing between the handle and the bottom of the basin, to allow easier access to the underside of the handle.

The foregoing description and drawing figures are presented for illustrative purposes. It will be apparent to those of ordinary skill in the art upon review of the foregoing that various modifications and variations can be made in the structure of the drain stopper of the present invention without departing from the scope or spirit of the invention. Thus, it is intended that the present invention cover the modifications and variations of the invention provided they come within the scope of the appended claims and their equivalents.

What is claimed is:

1. A drain stopper for a basin having a bottom comprising:

a sealing member sized to provide a fluid-tight seal at a drain in said basin;

a stopper lift assembly comprising an elongate rod and means for retaining said rod in a position extending transversely across an upper surface of said sealing member, said retaining means permitting said rod to rotate about its longitudinal axis, said rod having a pair of legs extending substantially perpendicularly to said rod, said pair of legs being mutually spaced to be capable of extending downwardly past opposing sides of said sealing member; and a handle attached to said rod and lying in substantially a same plane as a plane defined by said rod and said pair of legs, said handle extending away from said rod in a direction opposite a direction in which said legs extend, said handle permitting rotation of said rod such that said pair of legs contacts a top surface of said drain to lift said sealing member.

2. A drain stopper as recited in claim 1, wherein said handle is substantially U-shaped, with a first and a second end thereof being secured to said rod at opposing sides of said retaining means.

3. A drain stopper as recited in claim 2, wherein said retaining means includes a pair of stabilizer elements secured to said upper surface of said sealing member and spaced apart thereon, each of said stabilizer elements comprising a loop through which said elongate rod passes, and a stabilizer leg secured to an upper surface of said sealing member.

4. A drain stopper as recited in claim 1, wherein said sealing member is a plug having a substantially frustoconical seating surface extending along a side wall thereof.

5. A drain stopper as recited in claim 1, wherein said sealing member is a flat disc.

6. A drain stopper as recited in claim 5, wherein said flat disc has an annular groove disposed in a lower surface thereof, and further has a resilient gasket disposed in said groove.

7. A drain stopper as recited in claim 5, wherein said flat disc has a plurality of arms extending downwardly from a lower surface thereof.

8. A drain stopper as recited in claim 1, further comprising a strainer assembly, said strainer assembly being secured to said sealing member at a lower side thereof, said strainer assembly having an extension assembly extending downwardly from said sealing member and having a screen element disposed at a lower extent of said extension member.

9. A drain stopper as recited in claim 8, wherein said extension assembly comprises a hollow cylindrical member having a plurality of holes extending through a wall of said assembly, said holes being spaced around a periphery of said assembly and along a length of said assembly.

10. A drain stopper as recited in claim 9, wherein said extension assembly and said screen have a cross-section dimension that is slightly smaller than a distance of said mutual spacing of said legs of said lifting assembly, whereby said extension assembly and said screen will be closely spaced from an inner wall of said drain.

11. A drain stopper as recited in claim 8, wherein said extension assembly comprises a plurality of equidistantly-spaced arms extending downwardly from said sealing member, said arms being so constructed and arranged to hold said screen at substantially a lower extent thereof.

12. A drain stopper as recited in claim 11, wherein said arms are spaced at a distance slightly smaller than a distance of said mutual spacing of said legs of said lifting assembly, whereby said arms and said screen will be closely spaced from an inner wall of said drain.

13. A drain stopper as recited in claim 1, wherein said handle is rotatable between a substantially horizontal orientation and a substantially vertical orientation, to selectively raise and lower said legs attached to said elongate rod.

14. A drain stopper as recited in claim 13, wherein an end of each of said legs is rounded to provide a camming surface against an upper surface of said drain.

* * * * *